United States Patent [19]

Thyssen

[11] 3,959,082

[45] May 25, 1976

[54] METHOD OF OPERATING A BATTERY OF COKE OVENS

[75] Inventor: Nicolaas Josephus Willibrordus Thyssen, Haarlem, Netherlands

[73] Assignee: Hoogovens Ijmuiden B.V., IJmuiden, Netherlands

[22] Filed: Nov. 12, 1973

[21] Appl. No.: 414,989

[30] Foreign Application Priority Data

Nov. 13, 1972 Germany ..... 2255500

[52] U.S. Cl. ..... 201/1; 202/141; 202/151; 236/15 B

[51] Int. Cl.[2] ..... C10B 47/00; C10B 49/00; C10B 51/00; C10B 53/00

[58] Field of Search ..... 201/1; 202/151, 139, 202/141, 142, 143, 144; 236/15 B

[56] References Cited

UNITED STATES PATENTS

| | | | |
|---|---|---|---|
| 3,556,947 | 1/1971 | Kumper | 202/151 |
| 3,607,660 | 9/1971 | Kumper | 201/1 |

*Primary Examiner*—Jack Sofer
*Assistant Examiner*—Frank Sever
*Attorney, Agent, or Firm*—Stevens, Davis, Miller & Mosher

[57] ABSTRACT

A method of operating a battery of coke ovens with which is associated regenerators with checkerwork which includes measuring the temperature in the upper part of the checkerwork in the regenerators and supplying fuel to the burners in the heating chambers in dependence upon the temperature measured.

5 Claims, No Drawings

METHOD OF OPERATING A BATTERY OF COKE OVENS

This invention relates to a method of operating a battery of coke ovens in the production of coke.

In a coke-oven battery, fuel supplied to burners is burnt in order to heat the ovens from heating chambers or flues, and regenerators containing checkerwork are employed to absorb heat from the burnt gas and subsequently after a switchover, to release the heat to incoming fuel and/or gas.

In recent large-capacity coking plants the heating flue temperature, i.e., the upper working temperature, is usually 1250° to 1350°C., so that the upper temperature limit which is the maximum temperature that the walls, consisting of silica blocks, may sustain is not reached. The temperature in the heating flues are measured with brightness pyrometers through inspection holes in the roof of the furnace, which holes may be closed when not being used for that purpose.

The coking time is determined by the temperture and, above all, by the width of the oven chambers. In the case of the normal temperatures mentioned above the coking time is between 10 and 25 hours. The lower of these values applies to narrow chambers (350 mm), the upper value to wide chambers (500 mm). The coking time can be altered within wide limits, although it is desirable to ensure that it is not shortened to such an extent that the upper utilization temperature is exceeded.

Coke-oven operation has hitherto been primarily controlled by economic considerations, so as to achieve maximum production in the coke ovens.

As is known, when coking has been completed the coke formed is ejected by the coke pusher ram from the narrow side (machine side) to the other side (coke side) and thence into the coke quenching car. Dense clouds of smoke are evolved, resulting in considerable pollution of the air. This pollution must be reduced as much as possible to aid environmental protection, without however inadmissibly inpairing the economic operation of the coking plant.

Both the requirements of maximum coke production and of minimizing air pollution when the coke is being ejected are mutually contradictory insofar as the coking time is concerned. It is with this problem that the invention is concerned.

Thorough investigations and tests relating to the problem, both practical and theoretical, have shown that the air pollution during ejection of an oven charge is principally attributable to "nests" of incompletely coked coal. Expressed diffferently, a completely coked oven charge will cause only small contamination of the air. It can be assumed that the oven charge has been coked when it has reached a temperature of 800°C. Thus, the minimum coking time is the time during which the coal must remain in the furnace for the whole coke cake (including the so-called nests) to reach a temperature of at least 800°C.

It has been found during the course of investigating different parameters, that alterations in the sieve analysis, volatility and composition of the coal mixtures do not have any measurable effect, for practical purposes, on the minimum coking time. Further, an increase in the moisture content usually results in a reduction of the dry bulk density and since the coking time is affected by these two factors in inverse ratio, they cancel one another out in a large measure from this point of view.

Thus, temperature measurement is the overridingly important factor in operating a battery of coke ovens.

As has been stated, this control has hitherto been carried out by the operating personnel by means of periodic pyrooptical temperature measurements on the base block in the heating chambers and at some distance from the oven roof. The on/off characteristic data for the burners are calculated on the basis of the extremely subjected observations made in this manner. In turn, on the basis of these characteristic data the operating personnel control the amount of gas fed to the burners of all the heating chambers. The drawbacks of this system are that a control of this kind is discontinuous and inexact. Measurement carried out on the oven roof is an unpleasant task, and moreover cannot be subsequently checked.

Measurement of the temperature through the charging openings is also unsatisfactory because — apparently in dependence on the composition of the coal, in particular on its moisture content — there may be an irregular temperature profile in the oven chamber, if measurement is carried out with thermoelements in a vertical steel tube, which extends through the charging opening of the oven; that is to say the temperature distribution in the oven chamber may be dependent, after various coking times, on the height of the oven.

Surprisingly, it has now been found that measurement of the temperature of the battery of coke ovens may be carried out in a much more favorable manner by means of temperature sensors which are positioned in the upper portion of the regenerators. This measurement is more satisfactory because it is continuous and reliable. Practical tests have shown that the temperature measured in this location corresponds well to the mean temperature of the battery of ovens, reduced by a constant which is determined according to the particular oven construction.

According to the present invention, therefore, there is provided a method of operating a battery of coke ovens of the kind described in the production of coke, wherein the supply of fuel to the burners in the heating chambers is controlled in dependence upon the temperature measured in the upper part of the checkerwork in the regenerators.

As a good and continuous measurement of temperature of the battery of ovens is made available by virtue of this discovery, heating control of the battery may, under normal operating conditions, be restricted to holding the temperature of the regenerators substantially constant by means of the heat supply. Thus, when the throughput of coal is altered, the quantity of heating gas supplied does not have to be brought into line before the regenerator alters. Furthermore, this manner of controlling the heat supply has the advantage that the accuracy of its determination is independent of the accuracy with which the quantity of gas and the calorific value of the gas are measured.

Furthermore, the firing of the furnace may become independent of the actual coke ejection program, subject to the condition that the actual coking time remains below the maximum value which is permissible for a given battery temperature.

It is usual to arrange the regenerators beneath the oven chambers and preferably the temperature is measured at the upper face of the checkerwork.

Preferably the temperature is measured at a plurality of spaced points, and conveniently, temperature measurement is carried out on a line parallel to and spaced from the coke side, in a region which should be unaffected by heat losses taking place through the coke doors of the oven chambers. The measurements may then be averaged.

The on/off ratio of the burners may be controlled in dependence on the temperature of the regenerators. Thus, heat supply to the battery no longer has to be accomplished by altering the quantity of gas or the chimney draft. The supply of heat may now be controlled by delaying the firing process for an additional time immediately after reversal (or switchover) of the battery of coking ovens.

This type of control affords the following advantages:

The supply of heat can be determined by timing devices, which determines the additional inoperative period;

The pressure level of the combustion system can be optimally matched to the structure and layout of the oven, because the flow of gas remains constant; and A control determining whether good combustion is being maintained may be ascertained simply by comparing pressure values and by gas analysis.

Further, it is possible to use the temperature measurements taken at the regenerators directly for controlling the supply of heat so that the regenerators are kept at a constant temperature.

The following simple rules may be applied on the occasion of disturbances in the charging of the individual chambers with coal, or on the occasion of disturbances in coke ejection:

When it appears likely that the disturbance will last no longer than e.g., two hours and that none of the ovens will be subjected to a longer coking time than the maximum premissible, the battery temperature should be kept constant. If, however, the disturbance lasts a length of time such that one of the ovens will have to be operated longer than the maximum coking time, the temperature of the battery should be reduced as quickly as possible, that is to say the gas should be switched off. At the end of the disturbance the battery must be restored as quickly as possible to the former temperature level.

A non-limiting example embodying the present invention will be described hereinafter.

In the course of a month the temperatures at the upper end of the checkerwork in the regenerators in an underjet furnace were measured. The furnace was arranged for a filling operation, with continuous regenerators, and had altogether 259 oven chambers, each of which was 12 m long, 4 m high, and 45 cm wide, the furnace being capable of a throughput of 4800 tons of coal on a dry basis per day. The temperatures were measured in those regenerators which lie in a row parallel to the coke side, approximately at the level of the fifth burner, as calculated from the coke side. The temperatures thus measured were compared with the usual measurements obtained with pyrometers. There was a constant difference of 70°C. ± 10°C. between the two sets of values. An advantage afforded by this arrangement for temperature measurement is that the temperature level is about 70° below the level of temperatures taken on the base block which is an advantage insofar as the useful working life of the thermocouples is concerned. The thermocouple is not mechanically stressed, because it is placed horizontally on the checkerwork of the regenerators, as a result of which the chances of disturbances in operation occurring from this cause are greatly reduced.

At the same time the feed of heat to the furnace battery was controlled by temperature measurements carried out at the regenerators. The temperature of the regenerators was maintained at 1250°C., and the supply of heat to the oven battery was, during normal operating conditions, corrected once in 24 hours, if the regenerator temperature altered more than 10°C. from the value of 1250°C., i.e., the predetermined value. It was assumed, as a rule of thumb, that 1% less supply of heat corresponded to a reduction of the daily average temperature of 5°C. It was found that the regenerator temperature could be maintained between 1240°C. and 1260°C. in site of large variations in coal throughput or in the supply of heat.

The location of the thermocouples approximately at the level of the fifth burner was chosen because the temperature in the regenerator is at its highest at that point. This is because the burners have a somewhat greater capacity in the vicinity of the coke side (where the coke oven is at its widest), and the effect of cooling, taking place by way of the door of the coke oven, is negligible at that point. The above-described location of the thermal element is, also, advantageous because the thermocouple is conveniently accessible from the walkway which is not true when temperature measurements are carried out from the oven roof.

If, e.g. twelve thermocouples, belonging to twelve successive regenerator locations, are connected in series a mean temperature may be obtained from which the off period of the burners (that is to say the time during which the burners are not functioning) may be calculated.

Control of the temperature in a coking plant is important, because it has a direct effect on the coking time, and thus on the coking product. To take an example, assme that the mean coking time is 17 hours. If the temperature subject to which the coking process takes place is increased by 100°, then the coking time may be about 2 hours shorter.

When the different thermocouples are connected in series, the mean thermal voltage, and hence the mean thermal voltage, and hence the mean temperature, may be calculated. If one of the thermocouples is inoperative, the total voltage is divided by 11 instead of by 12.

The thermal voltage may be ascertained in a different way, for example, with the thermocouples connected to one another in electrical parallel by means of capacitors, and the conditon of charge of the capacitors can then be read off in sequence.

Instead of using the temperature measurement to control the on/off ratio of the burners, it may naturally be used to vary the quantity of combustion gas supplied.

Thus by the present invention, it is possible to operate a coke oven battery so that a predetermined coal charge is completely coked within an optimal period of time, while at the same time the emission of contaminating substances is reduced a maximum amount during ejection of the coke from the chambers of the oven battery.

What is claimed is:

1. In a method of operating a battery of coke ovens having regenerators with checkerwork arranged beneath the oven chambers associated therewith comprising maintaining a constant flow of gas through the battery of coke ovens, measuring a temperature and controlling the on/off ratio of the burners in the heating chambers responsive to said measured temperature so as to maintain said temperature substantially constant, the improvement comprising, measuring said temperature in the upper part of the checker work in the regenerators at a plurality of spaced points in a row substantially parallel to and spaced from the coke side of the ovens.

2. The method according to claim 1, wherein the temperatures measured at the plurality of points is averaged for the purposes of control of the fuel supply to the burners.

3. The method according to claim 1, wherein the said temperature is measured at the upper face of the checkerwork.

4. The method according to claim 1 including connecting a plurality of thermocouples together in electrical series to measure the said temperature.

5. The method according to claim 1, including connecting a plurality of thermocouples together, by way of capacitors, in electrical parallel, to measure the said temperature, the condition of charge of the capacitors being susceptible of reading-off in sequence.

* * * * *